United States Patent [19]

Yoshida et al.

[11] 4,423,290

[45] Dec. 27, 1983

[54] SPEECH SYNTHESIZER WITH CAPABILITY OF DISCONTINUING TO PROVIDE AUDIBLE OUTPUT

[75] Inventors: Hideo Yoshida, Kashihara; Hiroshi Tsuda, Uji, both of Japan

[73] Assignee: Sharp Kabushiki Kaisha, Osaka, Japan

[21] Appl. No.: 218,752

[22] Filed: Dec. 22, 1980

[30] Foreign Application Priority Data

Dec. 28, 1979 [JP] Japan ..... 54-171551

[51] Int. Cl.[3] ..... G10L 1/00

[52] U.S. Cl. ..... 381/51; 364/513; 381/104

[58] Field of Search ..... 179/1 SM, 1 SA, 1 SC, 179/1 P, 1 VL, 1 VC; 364/513, 710; 455/221, 478

[56] References Cited

U.S. PATENT DOCUMENTS

| | | | |
|---|---|---|---|
| 4,135,590 | 1/1979 | Gaulder | 179/1 P |
| 4,142,066 | 2/1979 | Ahamed | 179/1 P |
| 4,185,169 | 1/1980 | Tanimoto et al. | 179/1 SM |
| 4,323,730 | 4/1982 | Brown | 179/1 P |

*Primary Examiner*—Emanuel S. Kemeny

*Attorney, Agent, or Firm*—Birch, Stewart, Kolasch & Birch

[57] ABSTRACT

A noise-free speech synthesizer is disclosed which interrupts an audible output of synthesized sounds during the period of time where a sound waveform signal is at a relatively low level (amplitude), that is, a voiceless interval, a silent interval or a pitch control interval, wherein a reference level is established for the purpose of controlling pitch. Such low-level cut-off avoids the harsh click of sound cut-off.

8 Claims, 5 Drawing Figures

SPEECH SYNTHESIZER WITH CAPABILITY OF DISCONTINUING TO PROVIDE AUDIBLE OUTPUT

BACKGROUND OF THE INVENTION

This invention relates to a speech synthesizer and more particularly to a speech synthesizer capable of discontinuing an audible output of a particular word.

It is generally known in the art of synthesis of speech to store information necessary for synthesis of a predetermined number of words within a memory and to synthesize selected ones of the words in sequence. When a speech synthesizer is to be used with particular electronic equipment as its output device, the need often occurs for immediately interrupting an audible output indicative of a particular word. For instance, providing that the speech synthesizer is incorporated into a measuring instrument to provide an audible message indicative of a measuring mode in operation, it may be desirable to interrupt an audible indication in switching between one and another mode of operation. However, if the speech synthesizer comes to a stop with a relatively high level of a sound waveform signal, then objectionable clicking noise would be developed.

OBJECTS AND SUMMARY OF THE INVENTION

With the foregoing in mind, it is an object of the present invention to provide a new technique of speech synthesis. The present invention attains the above mentioned object by interrupting an audible output of synthesized sounds during a period of time where a sound waveform signal is at a relatively low level (amplitude), that is, a voiceless interval, a silent interval or a pitch control interval where a reference level is established for the purpose of controlling pitch.

BRIEF DESCRIPTION OF THE DRAWINGS

The present invention will be better understood from the detailed description given hereinbelow and the accompanying drawings which are given by way of illustration only.

DETAILED DESCRIPTION OF THE INVENTION

Figure 1:
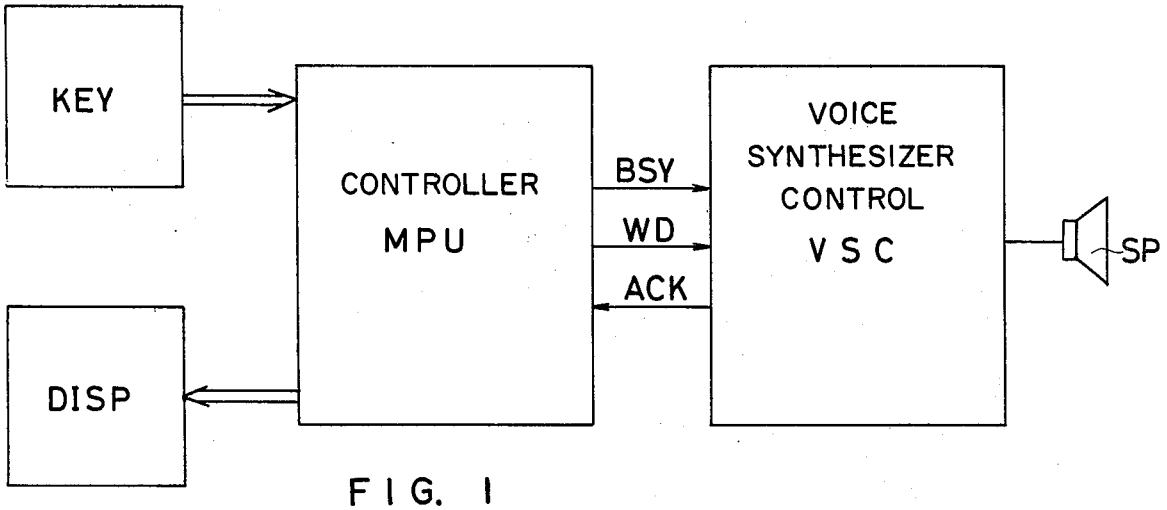
FIG. 1 is a schematic of a speech synthesizer in accordance with the present invention.

Referring now to FIG. 1, there is illustrated a combination of a keyboard unit KEY, a display DISP and a microprocessor MPU for executing desired operations in response to inputs introduced via the keyboard unit KEY and providing audible outputs of processed results. A voice synthesizer control VSC handles the processed results from the microprocessor MPU for developing audible speech through a loud speaker SP. MPU feeds information to be audibly delivered to VSC which in turn delivers data (word codes) WD indicative of words to be synthesized together with a busy signal BSY or one of control signals. VSC provides another control signal ACK for MPU. The BSY signal and the ACK signal governs serial-transmissions of the word codes WD from the microprocessor MPU to the speech synthesizer control VSC.

Figure 2:
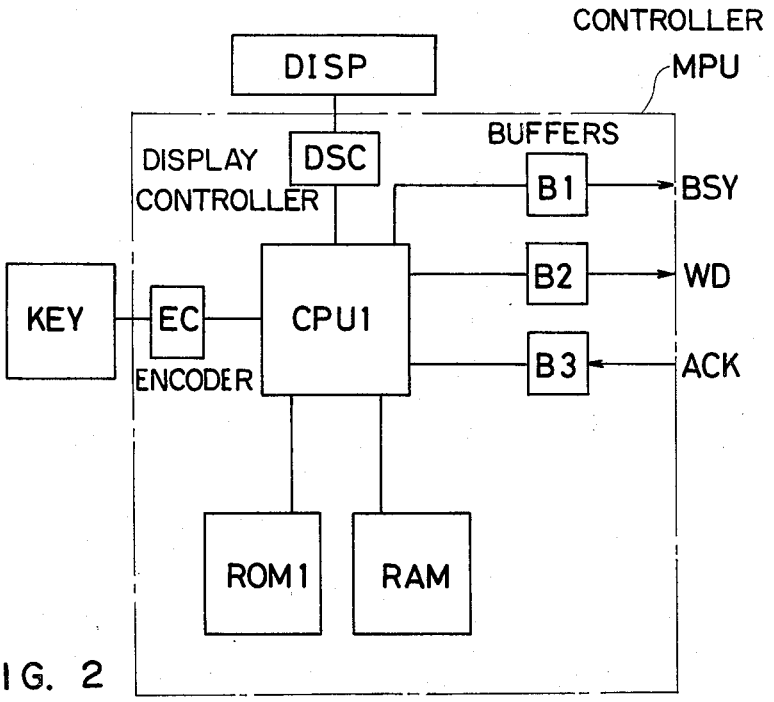
FIG. 2 is a block diagram of a microprocessor used in the speech synthesizer of FIG. 1.
Figure 3:
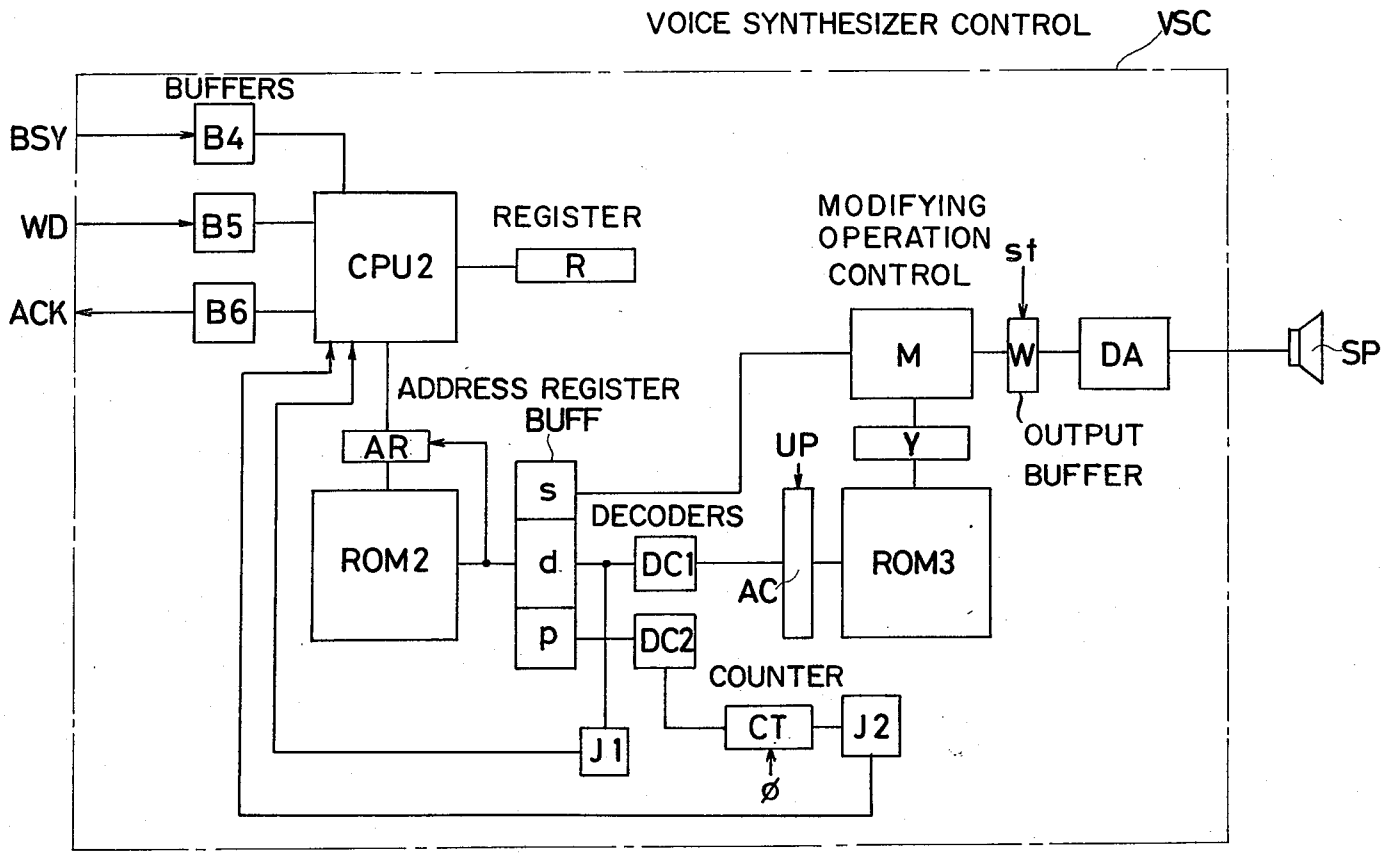
FIG. 3 is a block diagram of an example of control circuitry for the speech synthesizer of FIG. 1.
Figure 4:
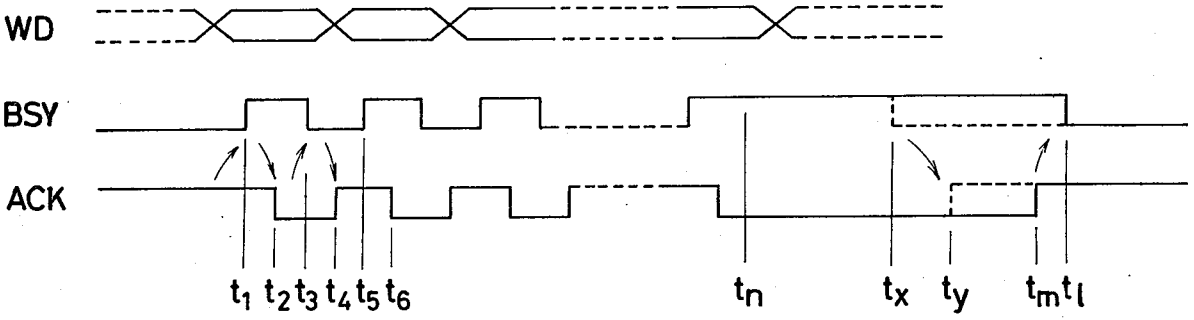
FIGS. 4 and 5 are waveform diagrams of various signals developed in the speech synthesizer.

FIG. 2 is a block diagram showing the microprocessor of FIG. 1 in more detail, FIG. 3 is a block diagram showing the speech synthesizer control VSC of FIG. 1 and FIG. 4 is a waveform diagram showing signals for explanation of operations of the microprocessor MPU and the speech synthesizer control VSC.

In FIG. 2, a processor CPU1 fetches sequentially instruction codes previously stored in a program memory (read only memory) ROM1 and executes desired operations according to those instructions. A random access memory RAM temporarily stores various kinds of information. An encoder EC encodes inputs introduced via the keyboard KEY. A display control DSC enables and disables the display DISP. There is further provided output buffers B1 and B2 and an input buffer B3.

When CPU1 is to provide the word codes WD, the ACK signal first assumes a "H" (high) level. If B3 is logical "1", then B2 is loaded with the first bit value (logical "1" or "0") of the word codes WD. By placing "1" into B1, the BSY signal assumes a "H" level ($t_1$ in FIG. 4). When the BSY signal assumes a "H" level, the speech synthesizer control VSC receives the first bit of the word codes. If the ACK signal assumes a "L" (low) level and the contents of B3 are "0", then CPU1 operates to load B1 with "0" and lower the BSY signal to a "L" level ($t_3$ in FIG. 4) and then load B2 with the second bit value of the word codes WD. The speech synthesizer control VSC senses that the BSY signal has been at a "L" level, increasing the level of the ACK signal to a "H" level ($t_4$ in FIG. 4). If the ACK signal is at a "H" level and the contents of B3 are "1", then CPU1 loads B1 with "1" and allows the BSY signal to assume a "H" level ($t_5$ in FIG. 4). The speech synthesizer control VSC recognizes that the BSY signal assumes a "H" level and receives the second bit value of the word codes WD. Thereafter, the ACK signal is lowered to a "L" level ($t_6$ in FIG. 4).

Through repetition of the above procedures the word codes WD are serially delivered. In this manner, data indicative of words to be audibly synthesized (the word codes) are transferred into VSC.

Referring to FIG. 3, there is illustrated the speech synthesizer control VSC which includes a processor unit CPU2 for synthesizing speech composed of words corresponding to the word codes WD. A register R temporarily stores the word codes introduced and a memory ROM2 stores a sequence of instructions for the procedure of speech synthesizing. Also provided is a digital-to-analog converter DA. It is understood that the speech synthesizer control VSC may be implemented with a well-known microprocessor LSI chip in a way similar to the processor MPU.

The speech synthesizer control VSC operates in the following manner. The word codes are first sent to R and ROM2 is addressed in response to those codes. Pursuant to the sequence of the speech synthesizing procedure contained in ROM2, ROM3 is addressed and DA converts the resulting digital signals into analog signals, developing audible synthesized speech.

While the speech synthesizer control VSC is not in operation (for instance, after the delivery of a previous audible indication), an output buffer B6 bears a logical "1" and the ACK signal remains at a "H" level ($t_1$ in FIG. 4). If CPU2 senses that input buffer B4 bears a logical "1", it receives the first bit of the word codes WD. In other words, the contents of the input buffer B5 are transferred to the register R. Then, B6 is loaded with "0" and the ACK signal assumes a "L" level ($t_2$ in FIG. 4). Provided that the BSY signal assumes a "L" level under these circumstances ($t_3$ in FIG. 4), the ACK signal would assume a "H" level and be ready for the next succeeding step where the BSY signal bears a "H" level. As soon as the BSY signal assumes a "H" level the contents of the input buffer B5 or the second bit of the word codes is transferred to the register R ($t_5$ in FIG. 4).

In this manner, the word codes are sequentially loaded into the register R. In the case where the word codes are 8 bits long, transmissions are performed eight times. In order for CPU1 to hold the BSY signal at a "H" level after the transmission of the eighth bit data, CPU2 receives the 8th bit data, holds the ACK signal at a "L" level ($t_n$ in FIG. 4) and initiates the procedure of speech synthesizing. Once the audible output of a particular word is completed, CPU2 places "1" into the output buffer B6 and allows the ACK signal to assume a "H" level, indicating to the microprocessor MPU that the audible indication of that particular word has been completed ($t_m$). In response to this information the microprocessor MPU allows the BSY signal to assume a "L" level ($t_1$). It is clear that the procedure of speech synthesizing is conducted beginning with transmission of the word codes.

Furthermore, when the audible output of the next succeeding word is desirable, the microprocessor MPU makes sure that the audible output of the previous word has been completed and starts transmitting that succeeding word as data. After the word codes WD of 8 bit long are shifted to the register R, CPU2 feeds to an address register AR an address code indicative of an address of ROM2 corresponding to those word codes. Information necessary for synthesis of that word is transferred from ROM2 to a buffer BUFF. "d" in BUFF identifies which information to use out of all of the pieces of basic sound information stored in ROM3, "p" stores pitch controlling data and "s" stores a variety of modifying data (for instance, data specifying what times the basic sound information is to be multiplied). A decoder DC1 decodes the contents of "d" and ROM3 has an address counter AC. The contents of ROM3 addressed by AC are sent to a register Y and to a modifying operation control M which executes modifying operations such as multiplication of the basic sound information derived from ROM3. in response to the development of an UP signal ROM3 is sequentially addressed up to develop address information in sequence. Digital sound values are fed sequentially to an output buffer W and to DA in synchronism with a sampling frequency signal sf. The contents of "p" in BUFF are decoded via the decoder DC2 and fed to a counter CT which decrements whenever a clock pulse signal $\emptyset$ is received.

Figure 5:
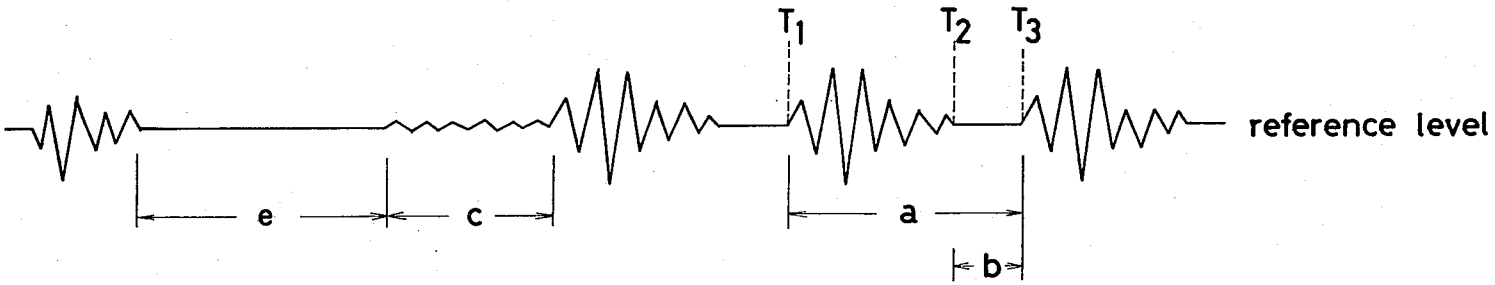

FIG. 5 shows an example of a sound waveform delivered via DA wherein "a" represents a one-pitch interval. Pitch controlling is achieved by controlling the length of "b" (that is, an added interval where a reference level is available). The length of "b" is determined by the contents of "p" in BUFF. It is appreciated that counter CT is set in response to the output of the decoder DC2 at point $T_1$ in time and holds its contents unchanged until a succeeding point $T_2$ in time. Therefore, CT begins decrementing at that point $T_2$ in time (the beginning of the pitch controlling interval) and keeps on decrementing until its contents reach "0". When CT="0" ($T_3$), CT stops decrementing. The speech synthesizer control proceeds with controlling the output of the next succeeding sound waveform. While CT is decrementing (in other words, within the interval "b"), the output of DA is maintained at the reference level.

Repetition of the above procedure completes speech synthesizing. However, the present invention executes the following steps when the speech synthesizer is to discontinue an audible output of a particular word. In this instance, the microprocessor MPU of FIG. 2 decreases the level of the BSY signal to a "L" level as depicted by $t_x$ in FIG. 4. The speech synthesizer control VSC senses that the BSY signal has been lowered to a "L" level, interrupting the procedure of speech synthesizing and delivering and holding the ACK signal at a "H" level ($t_y$ in FIG. 4). However, if the speech synthesizer comes to a sudden stop while delivering an audible output with a relatively high level of a sound waveform signal, abrupt transients in waveform would cause noise which is very harsh to the ear.

As stated above, the present invention eliminates such possible noise by interrupting operation of the speech synthesizer at point in time where a sound waveform signal stands at a relatively low level (approximately equal to the reference level).

In FIG. 5, "c" indicates a voiceless interval and "e" indicates a silent interval. A decision circuit $J_1$ of FIG. 3 decides if the basic sound information as specified by "d" in BUFF is voiceless information or silent information and another decision circuit $J_2$ decides if the counter CT is in decrement mode (in other words, if CT is less than $N_p$ wherein $N_p$ is an initial value resulting from decoding operation by the decoder DC2 with regard to the contents of "p" of BUFF). Both of the decision circuits provide its output signals for CPU2.

In response to the output signals from the decision circuits $J_1$ and $J_2$, CPU2 determines whether the BSY signal assumes a "L" level during the silent interval ("e" in FIG. 5), the voiceless interval ("c" in FIG. 5) or the pitch controlling interval ("b" in FIG. 5). If the BSY signal assumes a "L" level at such times, then the speech synthesizer interrupts the procedure of providing an audible output and is ready for the introduction of new data (word codes). Otherwise, the speech synthesizer does not interrupt the procedure of providing the audible output even with the BSY signal at a "L" level unless it reaches the first voiceless, silent or pitch controlling interval.

It is understood that the illustrated embodiment employs as a sound interruption instruction the BSY signal which serves as one of the control signals in handling the word codes, thus providing simplicity of control signals necessary for the speech synthesizer control. In addition, it is already noted that the speech synthesizer according to the present invention discontinues providing an audible output at the point in time where the amplitude of a sound waveform signal is relatively small, thus eliminating noise which may occur otherwise.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A speech synthesizer device comprising:

synthesizing means for providing a sound synthesis waveform signal in response to an input signal applied thereto;

instructing means for providing an interruption instruction when speech synthesis by said synthesizer device is to be interrupted;

means for determining the level of the waveform signal; and interrupting means responsive to said determining means and operatively connected to said synthesizing means for interrupting said synthesizing means in response to the instruction from said instructing means when the waveform signal is at a relatively low amplitude level.

2. A speech synthesizer device according to claim 1 wherein said synthesizing means is interrupted when said sound synthesis waveform signal is at a level indicating a voiceless interval or a silent interval.

3. A speech synthesizer device according to claim 1 wherein said synthesizing means is interrupted when it is within a pitch controlling interval.

4. A speech synthesizer device according to claim 1 wherein said determining means comprises first means for determining if said sound synthesis waveform signal is at a level indicating a voiceless or silent interval.

5. A speech synthesizer device according to claim 4 wherein said first means determines the amplitude level of the sound synthesis waveform signal with regard to a reference level.

6. A speech synthesizer device according to claim 1 wherein said determining means comprises second means for determining if said synthesizing means is in a pitch controlling interval.

7. A speech synthesizer device according to claim 6 wherein said second means includes counting means for determining the length of said pitch controlling interval.

8. A speech synthesizer device as in claim 4, wherein said first means comprises means for detecting data representative of the level of the waveform signal.

* * * * *